United States Patent [19]

Suganuma

[11] 4,226,110

[45] Oct. 7, 1980

[54] HYDRAULIC COMPRESSION TOOL

[75] Inventor: Yasuo Suganuma, Nagano, Japan

[73] Assignee: Izumi Products Company, Matsumoto, Japan

[21] Appl. No.: 925,416

[22] Filed: Jul. 17, 1978

[30] Foreign Application Priority Data

Aug. 22, 1977 [JP] Japan ..... 52/112747

[51] Int. Cl.[3] ..... B21D 7/06

[52] U.S. Cl. ..... 72/416; 72/453.16; 137/454.5

[58] Field of Search ..... 72/453.16, 453.15, 402, 72/412; 416, 414, 415, 410; 137/454.5, 362, 469

[56] References Cited

U.S. PATENT DOCUMENTS

| | | | |
|---|---|---|---|
| 1,956,778 | 5/1934 | Slagel | 137/454.5 |
| 2,043,453 | 6/1936 | Vickers | 137/469 |
| 2,254,613 | 9/1941 | Matthysse | 72/453.16 |
| 2,696,850 | 12/1954 | Peterson | 72/453.16 |
| 2,729,063 | 1/1956 | Hoadley | 72/453.16 |
| 2,869,407 | 1/1959 | Swanson | 72/453.16 |
| 3,030,838 | 4/1962 | Klingler | 72/453.16 |
| 3,154,981 | 11/1964 | McDurmont | 72/402 |
| 3,389,717 | 6/1968 | Povalski | 137/454.5 |
| 3,459,218 | 8/1969 | Cranage | 137/469 |
| 4,132,107 | 1/1979 | Suganuma | 72/453.16 |

*Primary Examiner*—Francis S. Husar
*Assistant Examiner*—Gene P. Crosby
*Attorney, Agent, or Firm*—Wegner, Stellman, McCord, Wiles & Wood

[57] ABSTRACT

A hand-operated hydraulic compression tool for compressing a metal connector about a plurality of wires to be connected. The tool is adapted to make both parallel and butt-type connections of the wires. The tool includes a pressure relief valve for limiting the maximum pressure to be applied to the connector. The valve is removably installed in a two-piece housing in a cavity of the tool body for facilitated servicing. The housing is provided with a plurality of outlet passages opening to an annular recess in the housing communicating through a suitable discharge opening with a fluid reservoir. The tool further includes control structure for releasing the pressure upon completion of a forming operation, the flow passage for the returning hydraulic fluid utilizing a portion of the body cavity receiving the pressure regulating valve.

5 Claims, 5 Drawing Figures

HYDRAULIC COMPRESSION TOOL

BACKGROUND OF THE INVENTION

1. Field of the Invention

This invention relates to compression tools, and in particular to hand-operated hydraulic compression tools.

2. Description of the Prior Art

A number of hydraulic compression tools have been developed for developing compression forces, such as approximately 12 tons of force, for compressing metal connectors about elements, such as wires, to be connected. The tools are provided with removable dies for accommodation to different connectors.

The tools conventionally include a pair of handles which are manipulated to provide the high pressure hydraulic piston advance with a control being provided for releasing the pressure upon completion of the connection compression.

It is further conventional in such tools to provide overload or pressure relief valves for limiting the maximum pressure applied to the connector to the preselected desired maximum. It has been conventional to form in the body of the tool a valve seat for cooperation with a movable valve member to effect the desired pressure regulation.

It has been further conventional in such tools to provide manual release means for releasing the hydraulic pressure upon completion of the compression operation and returning the hydraulic fluid to a reservoir which conventionally may be disposed within one of the operating handles.

SUMMARY OF THE INVENTION

The present invention comprehends an improved hydraulic compression tool wherein the pressure relief valve comprises a cartridge valve readily removably installed in a two-piece housing within a cavity within the tool body permitting facilitated servicing thereof as desired.

The housing is provided with a plurality of outlet passages opening to an annular recess in the housing communicating through a suitable discharge opening with a fluid reservoir.

The present invention further comprehends the provision of a portion of the flow passage for the pressure release function at completion of the compression operation, which utilizes a portion of the cavity for receiving the pressure regulating valve.

The invention provides for facilitated maintenance of the hydraulic fluid control means so as to permit maintained accuracy in the regulating function while yet maintaining the structure of the tool extremely simple and economical.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figure 2:
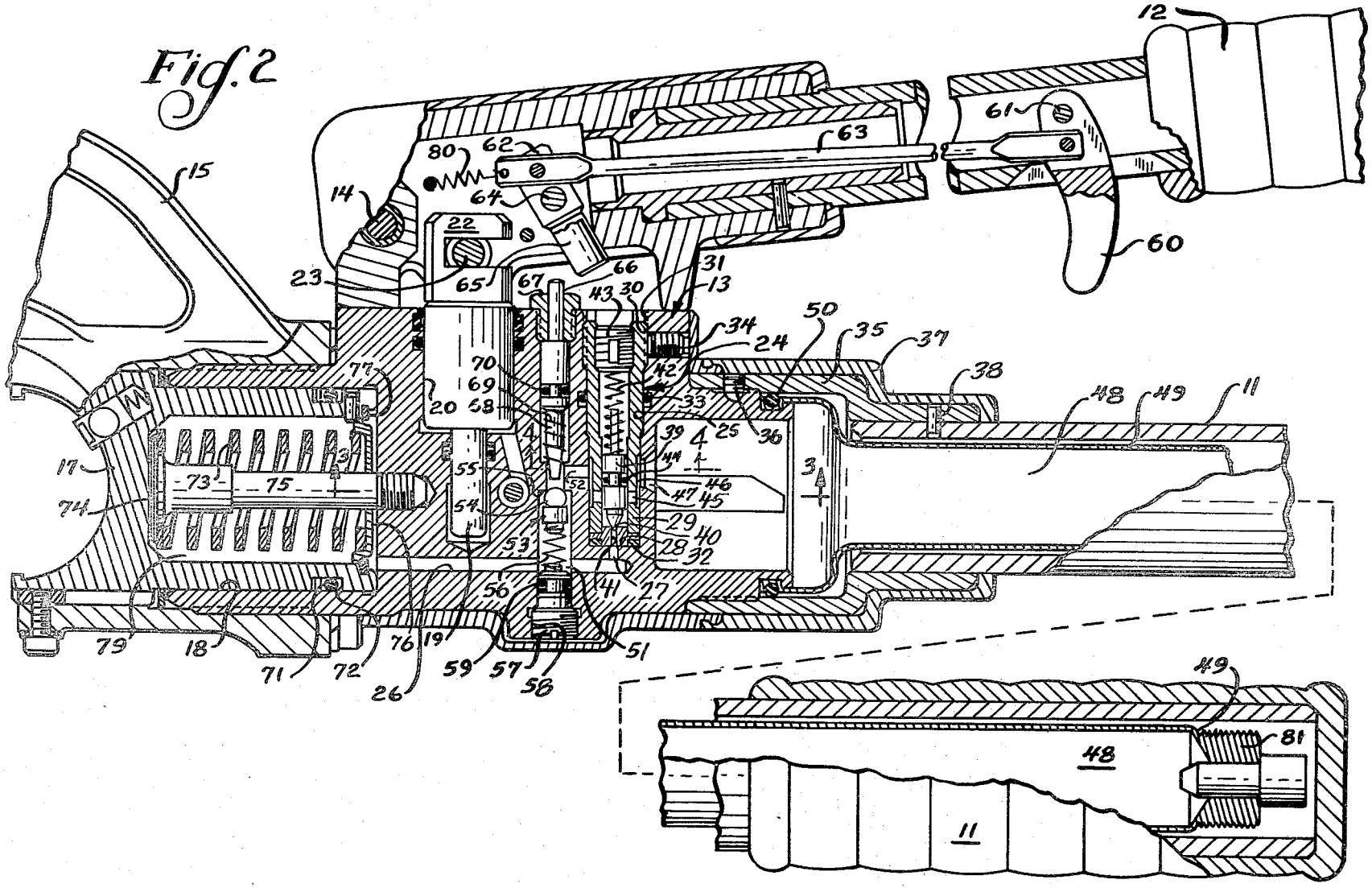
FIG. 2 is a fragmentary longitudinal section thereof.

In the exemplary embodiment of the invention as disclosed in the drawing, a manually operable hydraulic compression tool generally designated 10 is shown to comprise a first handle 11 and a second handle 12. The first handle is fixedly connected to a body 13 and the second handle is pivotally connected to the body by means of a suitable pivot 14. The body carries a compressing head 15 adapted to carry any one of a plurality of different compression die sets 16. In the illustrated embodiment, die **16*a* is fixedly carried in a distal portion 15*a* of the head 15 and die 16*b* is movably carried therein to be urged toward the fixed die 16*a* by a piston 17 slidably mounted in a cylinder bore 18 of the body. As shown in FIG. 2, the piston is biased rearwardly, i.e., to urge movable die 16*b* away from fixed die 16*a* or to the right, as seen in FIG. 2, by suitable compression spring 73 compressed between a spring follower 74 and a strap 76** carried by the inner end of the piston.

Figure 5:
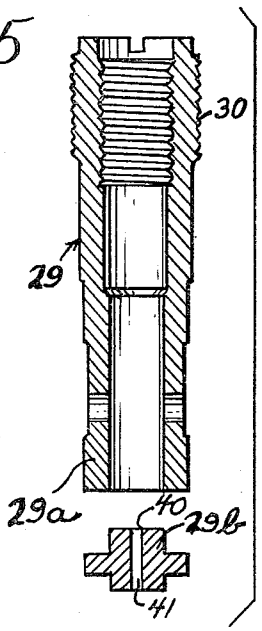
FIG. 5 is an exploded diametric section of the two-piece relief valve housing.
Figure 4:
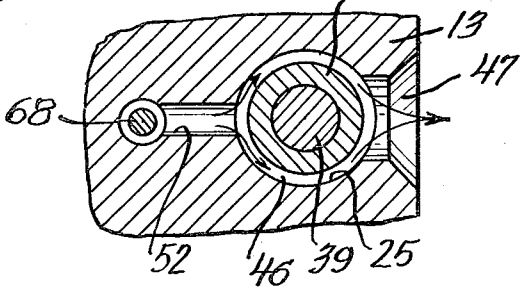
FIG. 4 is a fragmentary longitudinal section taken substantially along the line 4—4 of FIG. 2.
Figure 1:
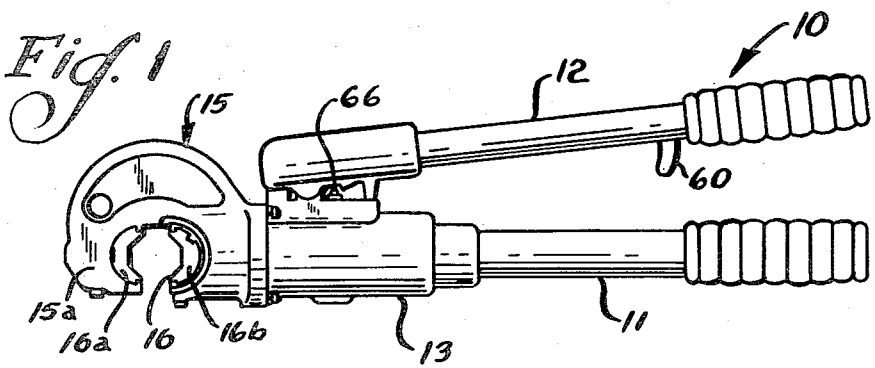
FIG. 1 is a side elevation of a compression tool embodying the invention.
Figure 3:
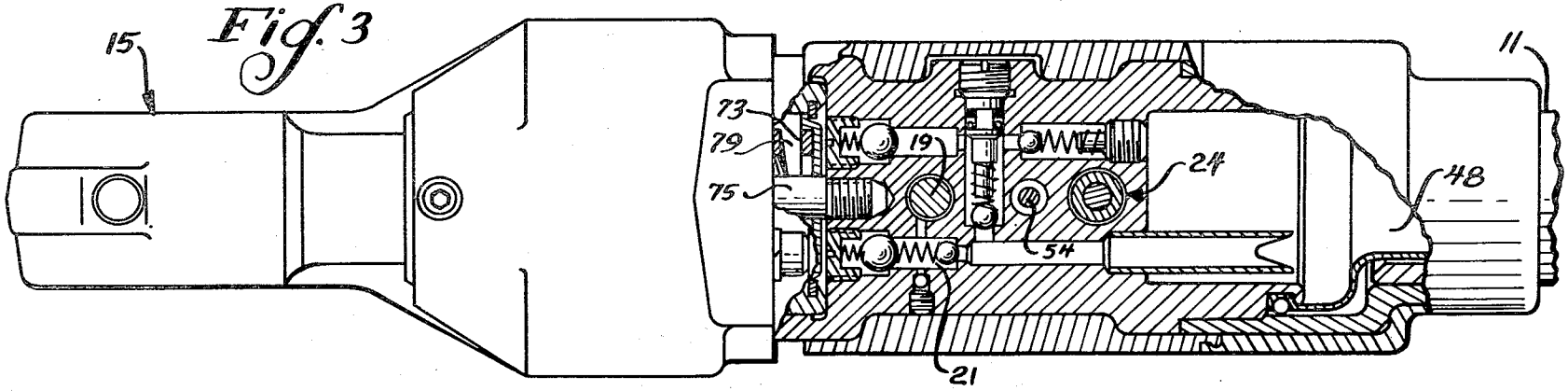
FIG. 3 is a fragmentary elevation shown partially in section.

As shown in FIG. 2, movement of the handle 12 toward the handle 11 causes a pump piston 19 received in a pump chamber 20 of the body to force hydraulic fluid from the chamber 20 through an inlet passage 21 into the cylinder 18 to urge the piston 17 to the left, as seen in FIGS. 2 and 3. Pump piston 19 is provided with an external yoke 22 cooperating with a force transfer pin 23 on the handle 12 to effect the desired reciprocal movement of the pump piston to provide the desired pressure within the cylinder 18 for providing a high compression force of the movable die **16*b* toward the fixed die 16*a*. Illustratively, in the illustrated embodiment, a force at the compression dies may be approximately 10.3 to 11.3 tons. The maximum hydraulic oil pressure may be approximately 680 kilograms per square centimeter. The maximum stroke of the movable die may be approximately 25 millimeters, and in the illustrated embodiment, is effected by approximately 16 operations of the handle 12 from the fully opened condition of the head 15**.

As indicated above, it is desirable to limit the maximum pressure of the oil so as to limit the maximum force applied by the dies to the connector. To this end, the tool 10 is provided with a pressure relief valve 24 received in a cavity 25 of the body 13.

Cavity 25 communicates with cylinder 18 by means of a pressure relief passage 26 in body 13 opening through a small inlet passage 27 to the inner end 28 of the cavity 25.

The pressure relief valve 24 comprises a cartridge valve having an outer two-piece housing 29 having a main tubular portion **29*a* received in cavity 25 and secured therein by a threaded outer end portion 30 threaded to an internally threaded outer end 31 of the cavity 25. The housing may be sealed to the body within cavity 25 by a first O-ring 32 engaging an inset portion 29*b* of the body press fitted into the lower end of the main portion 29*a* at the inner end 28 of the cavity, and a second O-ring 33 engaging the body inwardly of the threaded outer end 31 of the cavity. The housing may be removably retained within the cavity as by a set screw 34**.

As further shown in FIG. 2, handle 11 is connected to the body by a connector 35 secured to the body by a suitable set screw 36. Set screws 34 and 36 are received within an outer insulating cover, or jacket, 37. The connector 35 may be further secured to the handle by a suitable dowel 38 also within the jacket 37.

The relief valve includes a suitable movable valve member 39 seating against a valve seat 40 at the inner end of an inlet passage 41 of the housing portion **29*b*. The movable valve member is biased against the valve seat by a suitable compression coil spring 42 urged inwardly by suitable threaded retainer 43 in the outer end of the housing. Valve member 39 may be movable sealed to the housing by means of an O-ring 44**.

Thus, when the pressure within piston cylinder 18 exceeds a preselected maximum pressure, valve member 39 is urged upwardly from the valve seat 40 to pass hydraulic fluid from inlet passage 41 to a plurality of radial outlet passages 45 in the housing leading to an annular recess 46 extending coaxially thereabout and communicating through an opening 47 in the body 13 with a reservoir chamber 48 defined by a tank 49 within the fixed handle 11. As shown in FIG. 2, the inner end of the tank is sealed to body 13 by a suitable O-ring 50.

As indicated briefly above, upon completion of the compression operation, it is desirable to relieve the hydraulic pressure within cylinder 18 by returning the hydraulic fluid to the reservoir 48 for a subsequent compression operation. The piston 17 is biased to the right, as seen in FIG. 2, by the spring 73 at this time causing hydraulic fluid to be urged into a cross passage 51 in the body communicating with the transfer passage 26 leading from the cylinder 18 to the pressure relief valve 24. The cross passage 51 communicates with the annular recess 46 through a passage 52. Flow of hydraulic fluid from passage 51 through passage 52 is controlled by a check valve 53 having a ball 54 seated on a valve seat 55 by a biasing spring 56 retained under compression thereagainst by suitable adjusting screw 57 received in a threaded portion 58 of the cross passage 51. The adjusting screw may be sealed to the body by suitable O-rings 59.

Normally, the check valve 53 is biased closed by spring 56 so as to prevent return of fluid from the cylinder 18 to the reservoir 48. However, upon completion of the compression operation, the operator may operate a suitable trigger 60 pivotally mounted to the handle 12 by a suitable pivot 61 and connected to an actuator 62 by means of a link 63 to pivot the actuator about a pivot 64 and thereby swing an operator 65 into alignment with a plunger 66 carried in a nut 67 threaded into the end of the cross bore 51 opposite the retainer 57. The actuator includes a nose portion 68 adapted to engage the ball 54 of check valve 53 when the plunger 66 is depressed by operator 65 as a result of the operator pulling trigger 66 to the right, as seen in FIG. 2, and subsequently moving handle 12 toward handle 11 to engage the operator 65 with the protruding outer end of the plunger 66. The plunger is biased outwardly by suitable coil spring 69 so as to normally space the nose 68 from the ball 54 and permit the check valve 53 to function in normal check valve manner. The plunger may be provided with suitable O-ring 70 to seal the plunger movably to the body in the cross bore 51.

Piston 17 may be movably sealed to the cylinder wall 18 by suitable O-ring 71 received in an annular recess 72 in the piston. The piston biasing spring 73 is compressed between the retainer head 74, which is shown in FIG. 2 is connected to the body 13 by a suitable stem 75. The other end of the spring is urged against the retainer plate 76 fixed to the piston by a lock ring 77 which is removably installed in the outer end of the piston to permit facilitated installation of the spring and retainer in the hollow space 79 within the piston.

As further shown in FIG. 2, a biasing spring 80 may be connected to the end of link 63 and to the handle 12 to bias the operator 65 to the retracted position. Thus, to release the pressure applied to the compression dies by the tool, the operator must consciously actuate trigger 60 with the handle 12 spaced from handle 11 to permit the operator 65 to swing into alignment with plunger 66 whereupon subsequent movement of the handle 12 toward handle 11 effects the desired opening of the check valve 53 to relieve the pressure in the piston chamber 18.

As further shown in FIG. 2, the reservoir tank 49 extends substantially the full length of the hollow handle 11 and is provided with a closure element 81 at the distal end.

In use, the operator mounts a suitable set of dies 16 in the head 15 and applies hydraulic pressure to the piston 17 by suitable operation of the pump piston 19 as a result of a series of pumping actions effected by moving handle 12 toward and from handle 11. The maximum hydraulic pressure applied to the piston 17 is limited by the pressure relief valve 24, thereby effectively assuring proper make-up of the compressed connection. The pressure relief valve is readily removable from the body cavity 25 for servicing as desired.

Upon completion of the make-up of the connection, the pressure within the piston cylinder 18 is relieved by suitable manipulation of the trigger 60 and handle 12 so as to cause operator 65 to urge plunger 66 inwardly thereby unseating ball 54 of check valve 53 and permitting the hydraulic fluid to return through the passage 52 to annular recess 46 of the pressure relief valve and from the recess through passage 47 to the reservoir chamber 48. Upon such release of the pressure, the spring 73 retracts the piston 17 to the retracted position of FIG. 2, permitting the user to insert a new workpiece to be connected or replace the dies, as desired.

Thus, the structure of the present invention is extremely simple and economical of construction while yet providing facilitated servicing as discussed above.

The two-piece construction of the housing 29 provides for more accurate concentricity of the movable valve member 39 relative to the valve seat 40 at the inner end of the inlet passage 41. As the housing portion **29*b* may be formed separately from the tubular portion 29*a*, it may be formed of material selected for optimum heat treatment characteristics or other desirable characteristics in the valve. The use of the separate insert portion 29*b* permits it to be machined to more accurate tolerances as desired and permits facilitated surface finishing of the valve seat portion 40**.

The use of a plurality of outlet passages 45 in the housing portion **29*a* provides equalization of hydraulic fluid pressure on the movable valve member 39**, thus maintaining concentricity thereof in the operation of the valve, and more specifically, maintaining concentricity in axial alignment of the movable valve member to the valve seat.

The foregoing disclosure of specific embodiments is illustrative of the broad inventive concepts comprehended by the invention.

I claim:

1. In a hydraulic compression tool for compressing a connector onto a wire end, said tool including a pair of complementary compression dies, means defining a reservoir for holding a supply of hydraulic fluid, a hydraulic force applying means for forcibly urging the dies toward a compressing disposition, a hydraulic pump for delivering hydraulic fluid from said supply under pressure to said force applying means to effect a compressing operation, means for selectively returning hydraulic fluid from said force applying means to said reservoir to release said dies subsequent to a compression operation, means defining a relief flow passage from said force applying means, and body means defining a cavity communicating with said relief flow passage and said reservoir, the improvement comprising:

a two-piece housing removably installed in said cavity including a first portion defining an inlet communicating with said relief flow passage, and a second portion defining an outwardly opening annular outlet communicating with the reservoir and a plurality of diametrically opposed radial outlet passages opening through said housing to said annular outlet;

a pressure relief valve removably installed in said housing and including a biasing spring for controlledly closing said inlet while permitting flow of said hydraulic fluid from said inlet to said opening to the reservoir when the pressure of the hydraulic fluid in said force applying means and relief flow passage exceeds a preselected maximum operating pressure; and release means for passing hydraulic fluid from said force applying means to said annular outlet for return to said reservoir to release said dies, and concurrently directing fluid pressure from said force applying means through said radial outlet passages as an incident of said passing of the hydraulic fluid, said radial outlet passages providing balanced flow of hydraulic fluid about the relief valve in said housing outwardly through said outlet passages and annular outlet to said reservoir when said pressure exceeds said maximum operating pressure and said radial outlet passages providing balanced inwardly directed pressure forces radially against said relief valve in said housing while concurrently permitting said biasing spring to have an increased biasing action against the valve when said release means is operated to release said dies so as to permit a series of finite centering actions as a result of a series of pressure buildup and pressure relief cycles.

2. The hydraulic compression tool of claim 1 wherein said housing second portion is threaded to said body means in said cavity and clamps said first portion therein.

3. The hydraulic compression tool of claim 1 wherein said housing first portion defines a valve seat formed of a material different from the material forming said housing second portion.

4. The hydraulic compression tool of claim 1 wherein said housing second portion is recessed within said cavity.

5. The hydraulic compression tool of claim 1 wherein said housing second portion is threaded to said body means in said cavity to clamp said first portion therein, and locking means are provided for releasably locking the housing second portion against threaded withdrawal from the cavity thereby to maintain said first portion fixedly clamped to the housing.

* * * * *